United States Patent [19]

Lindsay et al.

[11] Patent Number: 4,729,826

[45] Date of Patent: Mar. 8, 1988

[54] TEMPERATURE CONTROLLED CATALYTIC DEMETALLIZATION OF HYDROCARBONS

[75] Inventors: David A. Lindsay, Orange; Michael C. Smith, Costa Mesa; Walter Albertson, Brea; Marvin J. Schwedock, Costa Mesa, all of Calif.

[73] Assignee: Union Oil Company of California, Los Angeles, Calif.

[21] Appl. No.: 834,783

[22] Filed: Feb. 28, 1986

[51] Int. Cl.[4] ..... C10G 45/02; C10G 45/00

[52] U.S. Cl. ..... 208/211; 208/216 R; 208/216 PP; 208/251 H; 208/254 H

[58] Field of Search ..... 208/210, 211, 216 PP, 208/251 H

[56] References Cited

U.S. PATENT DOCUMENTS

| | | | |
|---|---|---|---|
| 3,926,784 | 12/1975 | Christman et al. | 208/210 |
| 3,980,552 | 9/1976 | Mickelson | 208/216 |
| 4,003,829 | 1/1977 | Burger et al. | 208/251 H |
| 4,102,822 | 7/1978 | Mulaskey | 252/465 |
| 4,212,729 | 7/1980 | Hensley, Jr. et al. | 208/210 |
| 4,431,526 | 2/1984 | Simpson et al. | 208/211 |
| 4,559,130 | 12/1985 | Reynolds et al. | 208/59 |

*Primary Examiner*—Paul E. Konopka

*Attorney, Agent, or Firm*—Dean Sandford; Gregory F. Wirzbicki; Alan H. Thompson

[57] ABSTRACT

In the catalytic processing of hydrocarbons, a hydrocarbon oil is successively contacted with a particulate catalyst in a first reaction zone and contacted at a higher temperature with a second portion of the particulate catalyst in the same reaction zone or in a second reaction zone.

43 Claims, No Drawings

TEMPERATURE CONTROLLED CATALYTIC DEMETALLIZATION OF HYDROCARBONS

BACKGROUND OF THE INVENTION

This invention relates to catalytic hydrocarbon processing, and particularly to hydrocarbon hydroprocessing, such as the process involving catalyzing the reaction of hydrogen with organosulfur, organonitrogen, and organometallic compounds. More particularly, this invention is directed to a process for hydrodemetallizing hydrocarbon liquids.

During the course of a typical process involving the catalytic refining of hydrocarbons, portions of contaminant metals and sulfur components contained in a hydrocarbon oil ordinarily are deposited on a porous particulate catalyst, causing a loss of catalytic activity and stability. Residual petroleum oil fractions, such as the heavy fractions produced in atmospheric and vacuum crude distillation columns, are especially undesirable as feedstocks for such catalytic refining processes due to their high contaminant metals and/or sulfur content. Economic considerations have recently provided new incentives for catalytic conversion of the heavy fractions to more marketable products. However, the presence of high concentrations of sulfur and contaminant metals precludes the effective use of residua as feedstocks for cracking, hydrocracking, and similar catalytic refining operations.

Methods are available to reduce the sulfur and metals content of residua. One such method is hydrodesulfurization, a process wherein a residuum contacts a catalyst usually containing hydrogenation metals on a porous refractory oxide support under conditions of elevated temperature and pressure and in the presence of hydrogen, such that sulfur components are converted to hydrogen sulfide, nitrogen components are converted to ammonia, while the contaminant metals are simultaneously deposited on the catalyst. The most common contaminant metals found in such hydrocarbon fractions include nickel, vanadium and iron. The extent of deactivation of the catalyst typically is a function of the amount of deposition of contaminant metals on the catalyst surface and in its pores, i.e., the usefulness of the catalyst steadily decreases as the amount of deposited metals increases with continued treatment of the residuum. Increased metals deposition as well as high coke deposition, may cause plugging of catalyst beds resulting in premature replacement of catalyst beds in the hydrocarbon refining reactors.

It has been recognized that hydrodesulfurization of hydrocarbons may involve removing a substantial proportion of contaminant metals prior to downstream removal of sulfur and nitrogen. For example in U.S. Pat. No. 4,431,526, contaminant metals are removed by contact with a relatively large pore first catalyst and then sulfur and additional contaminant metals are subsequently removed by a relatively small pore downstream catalyst. Another typical example of a demetallization process is disclosed in U.S. Pat. No. 4,548,710 wherein a relatively large pore demetallization catalyst accumulates (deposits) its own fresh weight in contaminant metals. Such a demetallization process allows the refiner to subsequently pass a feedstock having a substantially reduced metals content over a high surface area desulfurization catalyst such as that prepared in accordance with U.S. Pat. No. 3,980,552.

Catalytic removal of metals from hydrocarbons involving multiple reaction zones provides only limited improvement to such problems as catalyst activity before undesirable characteristics such as catalyst stability (i.e. catalyst life) are adversely affected. A need still exists for an improved process for depositing contaminant metals on a particulate catalyst.

It is, therefore, a major object of the present invention to provide a process for removing contaminant metals from a hydrocarbon oil, and more specifically to provide a catalytic hydrodemetallization process while simultaneously removing a substantial proportion of sulfur and Conradson carbon from a hydrocarbon oil.

It is another object of the invention to provide a multi-reaction zone process for the catalytic hydrodemetallization of a hydrocarbon oil, and more specifically to provide a process for substantially hydrodemetallizing a heavy hydrocarbon oil prior to substantially hydrodesulfurizing the oil.

A further object of the invention is to provide hydrocarbon products of reduced metals content so as to extend the life of downstream refining catalysts.

These and other objects and advantages of the invention will become apparent from the following description.

SUMMARY OF THE INVENTION

The present invention is directed to a process for removing contaminant metals from a hydrocarbon oil by successively contacting at least two portions of a particulate catalyst with the oil under demetallization conditions and wherein the weighted average catalyst bed temperature of an upstream portion of the particulate catalyst is lower than the weighted average catalyst bed temperature of a downstream second portion of the particulate catalyst. In a multi-reaction zone process for catalytically processing hydrocarbon oils, a large pore hydrodemetallization catalyst is employed in at least two reaction zones wherein the first reaction zone has a lower weighted average catalyst bed temperature than that of the second reaction zone. The product hydrocarbon from the second reaction zone contains a hydrocarbon oil having a substantially reduced contaminant metals content and, in one embodiment, such an oil then contacts a hydrodesulfurization catalyst in a third reaction zone to produce a product hydrocarbon having a substantially reduced sulfur and metals content.

In a multi-reactor demetallization process, a lower weighted average catalyst bed temperature in an upstream reactor provides a uniform deposition of contaminant metals on the hydrodemetallization catalyst located in upstream and downstream reactors. Although the hydrocarbon oil contacting the hydrodemetallization catalyst in an upstream reactor contains substantially more contaminant metals than the effluent hydrocarbon oil from the upstream reactor which contacts the hydrodemetallization catalyst in the downstream reactor, the process of the invention provides substantial contaminant metals deposition on the hydrodemetallization catalyst located in the downstream reactor as compared to that in the upstream reactor. As compared to a process employing two reactors at the same temperature, the process of the invention provides unusual improvement in sulfur and Conradson carbon removal in addition to the uniform deposition of contaminant metals on the particulate catalyst.

DETAILED DESCRIPTION OF THE INVENTION

A hydrocarbon oil is catalytically treated in a reaction zone containing a catalyst bed capable of having temperatures maintained in upstream portions of the bed that are at least 5° F. lower than those in downstream portions of the bed. A hydrocarbon oil may also be treated serially in two or more reaction zones containing the same particulate catalyst. The upstream reaction zones have a lower weighted average catalyst bed temperature than the weighted average catalyst bed temperatures of the downstream reaction zones. The process of the invention is particularly well suited for hydrodemetallization of a hydrocarbon oil containing a high content of contaminant metals and sulfur and most particularly for a multireaction zone hydrodesulfurization process emphasizing demetallization in upstream zones and desulfurization in downstream zones. Furthermore, the process of the invention is highly effective for simultaneous hydrodemetallization and hydrodesulfurization of hydrocarbons and for simultaneous hydrodemetallization and Conradson carbon removal from hydrocarbon oils.

The invention is directed to a process for utilization of particulate catalysts, and more preferably, of hydroprocessing catalysts comprising hydrogenation metals on a support, and more preferably still of a hydrodemetallization catalyst or a hydrodesulfurization catalyst containing Group VIII and Group VIB metal components on a support material typically containing a porous amorphous refractory oxide. Porous refractory oxides useful in the particulate catalyst of the invention includes silica, magnesia, silica-magnesia, zirconia, silica-zirconia, titania, silica-titania, alumina, silica-alumina, and the like. Mixtures of the foregoing oxides are also contemplated especially when prepared as homogeneously as possible. The preferred refractory oxide material comprises aluminum and is usually selected from the group consisting of alumina and silica-alumina. For either hydrodemetallization or hydroesulfurization, a support material containing gamma alumina is most highly preferred.

Contemplated for treatment by the process of the invention are hydrocarbon-containing oils, including broadly all liquid and liquid/vapor hydrocarbon mixtures such as crude petroleum oils and synthetic crudes. Among the typical hydrocarbon oils contemplated are top crudes, vacuum and atmospheric residual fractions, vacuum and atmospheric gas oils, creosote oils, shale oils, oils from bituminous sands, coal-derived oils, and blends thereof, which contain sulfur and one or more contaminant metals such as vanadium, nickel, iron, sodium, zinc, titanium and copper. The hydrocarbon oil finding particular use within the scope of this invention is any heavy hydrocarbonaceous oil, at least 15 volume percent and preferably 50 volume percent of which boils above 1,000° F. and which has greater than about 10 ppmw, preferably greater than about 50 ppmw and most preferably greater than 100 ppmw of nickel plus vanadium contaminant metals. A typical residuum oil for treatment herein is high boiling (i.e., at least 95 percent of its constituents boil above about 400° F.), often contains undesirable proportions of nitrogen, usually in a concentration between about 0.2 and 1.0 weight percent, calculated as N, and contains undesirable portions of sulfur typically between about 1 and 8 weight percent of sulfur, calculated as S.

The particulate catalyst is typically employed in a fixed bed of particulates in a suitable reactor vessel wherein the oils to be treated are introduced and subjected to elevated conditions of pressure and temperature, and ordinarily a substantial hydrogen partial pressure, so as to effect the desired degree of demetallization of the oil. The particulate catalyst is maintained as a fixed bed with the oil passing upwardly or downwardly therethrough, and most usually downwardly therethrough. Such catalysts employed in the process of the invention may be activated by being sulfided prior to use (in which case the procedure is termed "presulfiding"). Presulfiding may be accomplished by passing a sulfiding gas or sulfur-containing liquid hydrocarbon over the catalyst in the calcined form; however, since the hydrocarbon oils treated in the invention ordinarily contain sulfur impurities one may also accomplish the sulfiding in situ.

In one embodiment of the invention, a catalyst bed of particulate catalyst is contacted by a hydrocarbon oil fed from an upstream inlet location, through a single reactor containing the catalyst bed, to a downstream outlet location. The single reactor contains means for effecting different temperatures upon one or more upstream portions of the catalyst bed or upon one or more downstream portions of the bed during processing. Such temperature controlling means include quench or heating gas streams selectively positioned along upstream and downstream portions of the catalyst bed, and heat exchangers positioned along the bed. It is preferred that the particulate catalyst be utilized in two or more reactors, such as in a multiple train reactor system having one or two reactors loaded with one type of particulate catalyst and the remaining reactors with one or more other particulate catalysts. In either the single reactor system or the multiple reactor system, the individual reactors are generally operated under an independent set of demetallizing and/or desulfurizing conditions selected from those shown in the following TABLE A:

TABLE A

| Operating Conditions | Suitable Range | Preferred Range |
|---|---|---|
| Temperature, °F. | 500–900 | 600–850 |
| Hydrogen Pressure, p.s.i.g. | 500–3,000 | 1,000–2,500 |
| Space Velocity, LHSV | 0.05–3.0 | 0.1–1.5 |
| Hydrogen Recycle Rate, scf/bbl | 1,000–15,000 | 2,000–10,000 |

In a single reactor embodiment, the upstream and downstream portions of the catalyst bed are contacted by a metals-containing hydrocarbon oil at demetallizing conditions including temperatures determined from the concentrations of contaminant metals in the respective portions of the oil contacting the upstream and downstream portions of the catalyst. In general, an upstream portion of the catalyst bed is maintained at a temperature lower than the temperature of a downstream portion of the catalyst bed. The temperatures of downstream portions of the catalyst bed are inversely related to the concentrations of contaminant metals contacting the corresponding downstream portions of the oil based on kinetic considerations including catalyst activity and operating conditions other than temperature. The temperature of an upstream portion of the catalyst bed is determined from the concentration of contaminant metals in the portion of the oil that contacts the upstream portion of the catalyst bed and must be sufficient to provide catalytic activity to remove a selected amount of contaminant metals from that portion of the oil. The temperature of a downstream portion of the catalyst bed is determined from the concentration of the portion of the oil that contacts the downstream portion of the catalyst bed and must be sufficiently higher than the temperature of an equivalent upstream portion of the catalyst bed so as to remove a second selected amount of contaminant metals from that portion of the oil contacting the downstream portion of the catalyst bed.

The selected amount of contaminant metals removed from a hydrocarbon oil, particularly the amount removed by the most upstream portion of the catalyst bed, depends upon such factors as the metals-accumulating capacity of the catalyst, the activity of the catalyst, the concentration of contaminant metals in the oil contacting the catalyst, operating conditions, and the like. In the present invention, the selected amount of contaminant metals removed in a downstream portion of the catalyst bed from a product hydrocarbon resulting from the contact of a hydrocarbon oil with the upstream portion of the catalyst bed is generally at least 25 percent, preferably about 75 percent to about 125 percent, and most preferably about 90 percent to about 110 percent of the selected amount of metals removed from the hydrocarbon oil having previously been contacted by an equivalent upstream portion of the catalyst bed. For instance, if a hydrocarbon oil containing 100 ppmw of contaminant metals contacts equal adjacent portions of a particulate catalyst in a catalyst bed, the temperature of the downstream portion of the catalyst bed is maintained at a temperature sufficient to remove at least about 10 ppmw, preferably about 30 ppmw to about 50 ppmw, and most preferably about 36 ppmw to about 44 ppmw of metals (i.e., the desired amount of contaminant metals) from the effluent obtained from the contacting of the upstream portion of the catalyst bed at a temperature sufficient to remove about 40 ppmw of metals from the initial hydrocarbon oil.

In a preferred embodiment of the invention, hydrocarbon oil is successively passed through at least two reaction zones, i.e. an upstream first zone and a downstream second zone, each zone containing a hydrodemetallization catalyst, at demetallizing conditions including a temperature of about 500° F. to about 900° F. and at a space velocity (LHSV) of about 0.05 to about 3.0 and in the presence of hydrogen at a partial pressure of about 500 to about 3,000 p.s.i.g., employed at a recycle rate of about 1,000 to about 15,000 scf/bbl. Preferably, the product hydrocarbon obtained from the first reaction zone is directly and rapidly passed into the second reaction zone, thus a connective relationship exists between the zones. In this connective relationship, the pressure between the zones is maintained such that there is no substantial loss of hydrogen partial pressure.

An unusual feature of the two-reaction zone embodiment of the invention involves intentionally lowering the weighted average catalyst bed temperature in the upstream first reaction zone as compared to the weighted average bed temperature of the downstream second reaction zone at the start of a processing run. Alternatively the weighted average bed temperature of the second reaction zone may be raised as compared to the weighted average bed temperature of the first reaction zone. Typically throughout a demetallizing run, the difference between the weighted average bed temperatures in the first and second reaction zones is at least 5° F., preferably at least 10° F., and ordinarily in the range from about 5° F. to about 100° F., and preferably about 10° F. to about 50° F.

The weighted average catalyst bed temperature for a typical commercial tubular reactor having a constant catalyst density and a linear temperature increase through the length of the bed is the average of the temperatures of the hydrocarbon oil at the inlet and outlet of the reactor. When the temperature increase through a catalyst bed is not linear, the temperatures of the weighted portions of the catalyst at selected bed locations must be averaged in accordance with the equation $(WABT)=\Sigma T\Delta W/W$ wherein WABT is the weighted average catalyst bed temperature, W is the weight to the catalyst, $\Delta W$ is the weight of a portion of the catalyst bed having a given average temperature T. (When the catalyst reactor bed has a constant catalyst density, then $\Sigma T\Delta W/W = \Sigma T\Delta L/L$ wherein L is the reactor bed length and $\Delta L$ is the length of a portion of the catalyst bed having a given average temperature T.) For example, a tubular reactor having a 15 foot catalyst bed with constant catalyst density and having a reactor inlet temperature of 700° F. and a reactor outlet temperature of 750° F. has a weighted average catalyst bed temperature of 716.7° F. when the temperatures are 705° F. and 720° F. at the 5 and 10 ft. catalyst bed positions, respectively.

The demetallization of hydrocarbon oils may typically include exothermic reactions and the heat generated from such reactions may be used to increase the temperature of downstream portions of a catalyst bed. However, such an uncontrolled transfer of heat downstream along a single catalyst bed, as in a single bed adiabatic reactor, is not within the scope of the present invention that provides a selected temperature sufficient to deposit a specified amount of contaminant metals onto the catalyst at a particular contacting location on the catalyst bed.

In the process of the invention at a particular downstream location in the catalyst bed, an uncontrolled transfer of heat downstream is either supplemented with the heat from an outside source (such as recirculated heating gas) or reduced by cooling means (such as fresh hydrogen quench gas) so as to conform to the selected temperature that is inversely related to the concentration of contaminant metals at the particular downstream contacting location.

Although a substantial amount of contaminant metals are removed in the first reaction zone, the higher temperature in the second reaction zone provides substantial reduction of contaminant metals in the second reaction zone as well. Such a substantial metals removal in the second reaction zone is evidenced by the weight percent of contaminant metals deposited on the particulate catalyst located in the second reaction zone. Anytime after the beginning of a processing run and typically after at least 120 days of contacting the particulate catalyst in the first and second reaction zones, the weight percent of contaminant metals, calculated on a fresh catalyst basis, deposited on the particulate catalyst in the first reaction zone is in a ratio less than about 4 to 1 as compared to the weight percent of contaminant metals deposited on the particulate catalyst in the second reaction zone. Preferably, such a ratio is less than about 2 to 1, and more preferably less than about 1.5 to 1 and the most suitable results being with ratios in the range between about 0.75 to 1 and about 1.25 to 1, and most preferably between about 0.9 to 1 and about 1.1 to 1. In a similar manner, after 175 days a ratio of less than 1.5 to 1 is evidenced.

In addition to effective contaminant metals removal, the invention provides unusually effective simultaneous hydrodesulfurization and/or Conradson carbon removal from a hydrocarbon oil. When the temperatures of downstream reaction zones are elevated relative to the upstream zones, the overall process of the invention results in significantly superior catalytic desulfurization of the oil as compared to an overall process employing the same catalyst in upstream and downstream reaction zones having a temperature intermediate to those of the reaction zones of the invention. Furthermore, in such a demetallization-desulfurization process of the invention, the desulfurization activity of the particulate catalyst is maintained for a considerably longer period of time than in the process operated at the intermediate temperature. In the same comparison as with desulfurization, the process of the invention provides unusually effective removal of Conradson carbon from an oil in addition to imparting long-term demetallization stability. Moreover, in comparison to a process operated at essentially a 1-tier intermediate temperature in multiple reaction zones, the overall multi-tier temperature process of the invention provides for demetallization of hydrocarbons with simultaneous improvement in nitrogen removal, asphaltene conversion, and bottoms conversion (including vacuum tower bottoms, VTB, and atmospheric tower bottoms, ATB). Ordinarily, the invention provides for improvement in the stability of any hydrocarbon conversion reaction involved in refining hydrocarbons and also for improvement in conversion of any hydrocarbon conversion reaction that has an activation energy higher than that for the conversion of the organometallic compounds converted in the demetallization process.

In a preferred embodiment involving multiple reactions zones, a relatively large pore hydrodemetallization catalyst and a relatively small pore hydrodesulfurization catalyst are successively contacted in three or more reactions zones with a hydrocarbon oil initially containing at least about 50 ppmw of nickel plus vanadium contaminant metals and at least about 1.0 weight percent of sulfur. The hydrodemetallization catalyst has an average pore diameter from about 120 to about 220 angstroms and is contacted with the hydrocarbon oil in the first two or more upstream reaction zones. The hydrodesulfurization catalyst has an average pore diameter from about 40 to about 110 angstroms and is contacted in one or more downstream reaction zones with the product hydrocarbon obtained from the "most downstream" reaction zone containing the hydrodemetallization catalyst. During the processing, the weighted average catalyst bed temperature of each of the successive reaction zones containing the hydrodemetallization catalyst is elevated by at least 5° F., and preferably at least 10° F., relative to the weighted average catalyst bed temperature of the preceding reaction zone.

The invention is further illustrated by the following examples which are illustrative of specific modes of practicing the invention and are not intended as limiting the scope of the invention as defined in the appended claims.

EXAMPLE I

A hydrodemetallization catalyst (A) and a hydrodesulfurization catalyst (B) are loaded into a series of five cylindrical, vertical hydrocarbon refining reactors. The reactors are connected in series such that no substantial loss of hydrogen partial pressure is affected between the reactors. Also, the effluent from each reactor is passed continuously to the following reactor.

The first and second reactors (Reactors 1 and 2), contain hydrodemetallization Catalyst A that is prepared in the same manner as that disclosed in U.S. Pat. No. 4,548,710 and has an average pore diameter of about 180 angstroms. The third, fourth and fifth reactors (Reactors 3, 4 and 5) contain hydrodesulfurization Catalyst B that is prepared in the same manner as that disclosed in U.S. Pat. No. 3,980,552 and has an average pore diameter of about 70 angstroms. Both the hydrodemetallization and hydrodesulfurization catalyst have a nominal composition as follows 12.0 weight percent of molybdenum components, calculated as $MoO_3$, 4.0 weight percent of cobalt components, calculated as CoO, with the balance containing gamma alumina. The volume ratio of Catalyst A to Catalyst B is 1 to 4. Catalysts A and B are conventionally presulfided and then contacted for ten (10) months with different atmospheric residuum feedstocks having characteristics shown in TABLE II and under hydrodemetallization and hydrodesulfurization conditions (overall process) summarized in TABLE III.

TABLE II

| Atmospheric Resid Feedstock Properties | Range | Average |
|---|---|---|
| Contam. Metals (Ni + V) ppmw | 10 to 130 | 50 to 60 |
| Sulfur, (S) wt. percent | 1.7 to 4.5 | 3.0 to 3.5 |
| Carbon Residue D-189 wt. percent | 4.5 to 11.5 | 7.0 to 7.5 |

TABLE III

| Operating Conditions | Range | Average |
|---|---|---|
| Space Velocity (LHSV) | 0.1 to 0.4 | 0.2 |
| Hydrogen Recycle (scf/bbl) | 3,000 to 8,000 | 4,500 to 5,500 |
| Hydrogen Pressure (p.s.i.g.) | 1,500 to 2,500 | 1,900 to 2,100 |

A portion of the feedstock is passed downwardly through each reactor and contacted with the described uniformly loaded catalysts in a single pass system with recycled hydrogen such that the effluent sulfur and contaminant metals concentrations in the effluent from the fifth reactor are maintained at less than 0.3 weight percent and less than 10 ppmw, respectively. Volume percentages of the product hydrocarbons (effluent from the fifth reactor) at the start of the ten month run (SOR) and at the end (EOR) of the ten month run are summarized in TABLE IV as follows:

TABLE IV

| Product Hydrocarbons | SOR | EOR |
|---|---|---|
| naphtha (350° F. minus b.p.), vol. % | 0.5% | 4% |
| light gas oil (350° F.-550° F. b.p.), vol. % | 3.5% | 16% |
| heavy gas oil (550° F.-650° F. b.p.), vol. % | 2% | 10% |
| bottoms (650° F. plus b.p.), vol. % | 94% | 70% |

The weighted average catalyst bed temperatures in each of the five reactors at the start and end of the ten month run are summarized in TABLE V as follows:

TABLE V

| Reactor No. | | SOR Temp., °F. | SOR WABT, °F. | EOR Temp., °F. | EOR WABT, °F. |
|---|---|---|---|---|---|
| 1 | inlet | 664 | 667.5 | 702 | 702.5 |
| | outlet | 673 | | 703 | |
| 2 | inlet | 667 | 680 | 711 | 726 |
| | outlet | 693 | | 741 | |
| 3 | inlet | 637 | 648.5 | 689 | 713.5 |
| | outlet | 660 | | 738 | |
| 4 | inlet | 642 | 649.5 | 714 | 727 |
| | outlet | 657 | | 740 | |
| 5 | inlet | 646 | 649.5 | 727 | 733.5 |
| | outlet | 653 | | 740 | |

The weighted average catalyst bed temperature of Reactors 1 and 2 are controlled throughout the run to maintain at least a 10° F. higher weighted average catalyst bed temperature in Reactor 2 than in Reactor 1.

After the ten month run, two separate portions of hydrodemetallization Catalyst A and hydrodesulfurization Catalyst B in Reactors 1 to 5 are analyzed to determine the weight percent of contaminant metals deposited on the catalyst, calculated on a fresh catalyst basis. The weight percents of contaminant metals deposited on Catalyst A in the catalyst beds from Reactors 1 and 2 and on Catalyst B in the catalyst beds from Reactors 3, 4 and 5 in two separate analysis of two representative portions of catalyst samples removed after the ten month run are summarized in TABLE VI as follows:

TABLE VI

| Reactor Source | Deposition of Ni Plus V on Catalyst: Analysis 1 wt. % (Ni + V) | Analysis 2 wt. % (Ni + V) |
|---|---|---|
| 1 Cat A | 15.3 | 27.1 |
| 2 Cat A | 39.4 | 27.8 |
| 3 Cat B | 6.0 | 3.5 |
| 4 Cat B | 2.2 | 1.2 |
| 5 Cat B | 1.3 | 0.9 |

In view of the data in TABLE VI relative to weight percent of contaminant metals deposited on Catalyst A in Reactors 1 and 2, the contaminant metals are uniformly deposited on the catalyst in the catalyst beds containing Catalyst A. In Analysis 1, the weight percent of metals deposited on Catalyst A in Reactor 1 is in a ratio of about 0.39 to 1 as compared to the weight percent of contaminant metals deposited on Catalyst A in Reactor 2. In Analysis 2, the aforementioned ratio is about 0.97 to 1.

EXAMPLE II

Two equal volumes of the hydrodemetallization Catalyst A in Example I (8773 cu. feet) are loaded into fixed beds in single reactor vessels. One vessel (Reactor X) contains a single fixed bed of hydrodemetallization Catalyst A. The other (Reactor Y) contains a fixed bed divided into ten equal volume sections of demetallization Catalyst A with means for controlling the temperature of each of the ten sections of the bed.

The catalyst is presulfided and utilized to demetallize a Heavy Arabian Atmospheric Resid feedstock (12.5° API gravity and containing 141 ppmw of nickel plus vanadium contaminant metals) under the conditions of 2,000 p.s.i.g. total pressure and a hydrogen rate of 10,000 scf/bbl. A portion of the feedstock is passed downwardly through the reactors at a liquid hourly space velocity (LHSV) of 0.8 (30,000 bbl/day) and contacted with the catalyst in a single stage, single pass system with once-through hydrogen such that the effluent contaminant metals concentrations are maintained at about 52.5 ppmw over 300 day runs, i.e. equivalent to about 62.8 percent demetallization.

The calculated desired rate constant of an entire bed (Reactor X) of particulate catalyst that provides initial activity sufficient to convert the feedstock from 141 ppmw metals to 52.5 ppmw metals over the 300 day period and to deposit 80.8 weight percent of (Ni+V) contaminant metals is 0.08607. Hydrodemetallization Catalyst A has a known initial rate constant (1.5 order kinetics at 700° F.) at the start of the run (SOR) of 0.0618. The required weighted average catalyst bed temperature for the entire bed at SOR is 720° F. to attain the desired conversion.

The following TABLE VII summarizes (1) the calculated desired rate constants of ten sections (Reactor Y) particulate catalyst providing initial activity sufficient to convert the feedstock from 141 ppmw metals to 52.5 ppmw metals over the 300 day run and to deposit 80.8 weight percent of (Ni+V) contaminant metals (calculated on a fresh catalyst basis) onto the catalyst in each section, (2) the corresponding initial weighted average catalyst bed temperatures of each of the ten sections of the catalyst bed and (3) the corresponding inlet and outlet concentrations of contaminant metals for each of the ten sections of the catalyst bed.

TABLE VII

| Section | 1 | 2 | 3 | 4 | 5 | 6 | 7 | 8 | 9 | 10 |
|---|---|---|---|---|---|---|---|---|---|---|
| Inlet Metals Concent., ppmw (Ni + V) | 141 | 132.1 | 123.2 | 114.3 | 105.4 | 96.5 | 87.6 | 78.7 | 69.8 | 60.9 |
| Outlet Metals Concent., ppmw (Ni + V) | 132.1 | 123.2 | 114.3 | 105.4 | 96.5 | 87.6 | 78.7 | 69.8 | 60.9 | 52.0 |
| Desired Rate Constant, $hr^{-1}$ $ppmw^{-0.5}$ | 0.0447 | .0494 | .0551 | .0619 | .0703 | .0807 | .0941 | .1115 | .1352 | .1685 |
| WABT, °F. | 681.0 | 686.9 | 693.2 | 700.1 | 707.7 | 716.1 | 725.5 | 736.1 | 748.4 | 762.8 |

At the start of the 300 day run (SOR), Reactor X containing the single bed of catalyst, has a weighted average catalyst bed temperature of 720° F. During the course of the 300 day run, the weighted average catalyst bed temperatures of each reactor are increased to maintain the desired degree of conversion. An increase in temperature of Reactor Y includes corresponding increases in each of the ten sections of the catalyst bed.

After the 300 day runs, Catalyst A is unloaded from Reactors X and Y and analyzed to determine the profile of the contaminant metals deposited along the catalyst beds in each reactor. The weight percentages of contaminant metals deposited on Catalyst A (on a fresh catalyst basis) in Reactors X and Y at comparative positions along the catalyst bed are summarized below in TABLE VIII. (Section 1 of Reactor Y corresponds to bed location of 1–10 wt.% of Catalyst A in Reactor X, Section 2 of Reactor Y corresponds to bed location of 11–20 wt.% of Catalyst A in Reactor X, etc.)

TABLE VIII

| Metals on Catalyst vs. Catalyst Bed Position | | | | | | | | | | |
|---|---|---|---|---|---|---|---|---|---|---|
| Bed Location, wt. % of fresh Cat A. (Reactor X) | 1-10 | 11-20 | 21-30 | 31-40 | 41-50 | 51-60 | 61-70 | 71-80 | 81-90 | 91-100 |
| Cat. A. wt. % of Ni + V (Reactor X) | 170-138 | 138-116 | 116-100 | 100-82 | 82-72 | 72-65 | 65-55 | 55-46 | 46-40 | 40-37 |
| Section (Reactor Y) | 1 | 2 | 3 | 4 | 5 | 6 | 7 | 8 | 9 | 10 |
| Cat. A. wt % of Ni + V (Reactor Y) | 82-78 | 82-78 | 82-78 | 82-78 | 82-78 | 82-78 | 82-78 | 82-78 | 82-78 | 82-78 |

In view of TABLE VIII, the profile of metals deposited along the bed of demetallization Catalyst A in Reactor Y of the invention is substantially more uniform than that in the single Reactor X. The upstream portions of the catalyst bed in Reactor X tend to plug and the downstream portions are substantially below the metals accumulating capacity of Catalyst A.

EXAMPLE III

Forty-five and fifty-five volume percent of fresh hydrodemetallization Catalyst A used in EXAMPLE I is loaded into the first and second fixed beds, respectively, of two interconnected reactor vessels (Process 1-T, reference process), and tested for overall desulfurization, demetallization and removal of Conradson carbon from a hydrocarbon oil. A second two-reactor system (Process 2-T of the invention), identical to Process 1-T except for operating temperatures in the individual reactors, is also tested for the same above-mentioned conversions of an equivalent portion of the same hydrocarbon oil.

The two-reactor processes are utilized in separate runs to hydrodesulfurize, hydrodemetallize and to remove Conradson carbon from Hondo atmospheric residua feedstocks having the characteristics shown in TABLE IX below under the following overall conditions: 2,000 p.s.i.g. total pressure and a hydrogen rate of 10,000 scf/bbl. The liquid hourly space velocity (LHSV) of the first reactor is 1.1, of the second reactor is 0.92 and the overall LHSV is 0.5.

TABLE IX

| Feed Properties | |
|---|---|
| Feed Description | Hondo Atmospheric Residua |
| Gravity °API | 12.3 |
| Nitrogen (kjel), wt % | 0.714 |
| Sulfur, wt % | 5.07 |
| Nickel, ppmw | 91 |
| Vanadium, ppmw | 222 |
| Carbon Residue, D-189, wt % | 10.6 |
| Asphaltenes, wt % | 21.3 |
| Distillation, Mod. Vac. Engler | |
| x-650 F. (vol. %) | 21.3 |
| 650-850 F. | 19.1 |
| 850-1,000 F. | 13.3 |
| 1,000-1,050 F. | 4.3 |
| 1,050+ F. | 42.0 |

A portion of the feedstock is passed downwardly through each reactor and contacted with Catalyst A in a single-pass system with once-through hydrogen such that the effluent metals concentration of nickel and vanadium contaminant metals, calculated as Ni+V, from the second reactor is controlled in both Process 1-T and 2-T to 20 ppmw, i.e., greater than 90 percent demetallization. After an initial period in each run to increase the temperatures and establish the high stability period of Catalyst A's life for demetallization (i.e., both Process 1-T and Process 2-T attained essentially 0.0° F./day temperature increase requirement (TIR) values), each run is continued for 20 more days to determine the relative activities and TIR values of Catalyst A for desulfurization and Conradson carbon removal from the Hondo atmospheric residua. During Catalyst A's period of high demetallization stability (Days 1-20) the upstream reactor and the downstream reactor in Process 1-T are operated at a weighted average catalyst bed temperature of about 760° F. During the same period in Process 2-T of the invention, the upstream reactor is operated at a weighted average catalyst bed temperature of about 748° F. and the downstream reactor is operated at a weighted average catalyst bed temperature of about 779° F.

Giving the catalyst employed at day 1 in the reference process an arbitrary activity of 100, relative activities of Catalyst A employed in the invention compared to Catalyst A employed in the reference process are determined by calculation and tabulated in TABLE X. These determinations are based on a comparison of the reaction rates for desulfurization or Conradson carbon removal obtained from the data of the experiment according to the following standard equation which assumes second order kinetics for desulfurization or Conradson carbon removal:

$$\text{Relative Deslfurization or Conradson carbon removal Activity} = \frac{(1/C_p) - (1/C_f)}{(1/C_{pr}) - (1/C_{fr})} \times 100$$

where $C_{fr}$ and $C_{pr}$ are the respective concentrations of sulfur or Conradson carbon in the feed and product obtained with the catalyst employed in the reference process and $C_f$ and $C_p$ are the respective concentrations of sulfur or Conradson carbon in the feed and product obtained with a catalyst being compared to the reference.

The TIR determinations are based upon calculation by a relatively simple formula. TIR may be determined by dividing the difference between two operating temperatures required to give a specific product on two given days in a run by run length interval between these days.

TABLE X

| Relative Activity and Stability for Hydrodesulfurization and Conradson Carbon Removal During Stable Hydrodemetallization | | | |
|---|---|---|---|
| | Relative Activity | | |
| Process | Day 1 | Day 21 | Stability, °F./day |
| | Hydrodesulfurization | | |
| 1-T | 100 | 85 | 0.60 |
| 2-T | 146 | 126 | 0.45 |
| | Conradson carbon | | |
| 1-T | 100 | 96 | 0.1 |
| 2-T | 148 | 148 | 0.0 |

The data summarized in TABLE X indicate that the temperature increase requirement (TIR) calculated in °F/day for both desulfurization and Conradson carbon removal is substantially lower for Catalyst A in the process of the invention (Process 2-T) as compared to Catalyst A of the reference process ((Process 1-T) The desulfurization deactivation rate of Catalyst A when employed in the reference process is 1.33 times greater than is the case when Catalyst A is employed in the process of the invention. The deactivation rate for Conradson carbon removal essentially parallels that for demetallization, having a TIR of essentially 0.0° F./day, i.e., high stability. In addition to this superiority in stability when employed in the process of the invention, Catalyst A also exhibits substantially improved activity for both desulfurization and Conradson carbon removal compared to Catalyst A in the reference process.

While particular embodiments of the invention have been described, it will be understood, of course, that the invention is not limited thereto since many obvious modifications can be made, and it is intended to include within this invention any such modifications as will fall within the scope of the appended claims.

We claim:

1. A catalytic process for removing contaminant metals from a petroleum hydrocarbon oil containing contaminant metals, said catalytic process comprising the following steps:

(1) contacting an upstream portion of a catalyst bed containing a particulate hydrometallization catalyst having a known metals-accumulating capacity under hydrodemetallizing conditions with said hydrocarbon oil to produce a product hydrocarbon oil containing less contaminant metals than said hydrocarbon oil, and (2) subsequently contacting a downstream portion of said catalyst bed under said hydrodemetallizing conditions of step (1), including a weighted average catalyst bed temperature controlled at least 5° F. higher than the weighted average catalyst bed temperature in step (1), with said product hydrocarbon obtained in step (1) to produce a second product hydrocarbon oil containing less contaminant metals than said product hydrocarbon oil obtained in step (1), and wherein said weighted average catalyst bed temperatures in step (1) and step (2) are sufficient to cause deposition of a weight percent of contaminant metals on said upstream portion of said catalyst bed, as calculated on a fresh catalyst basis, in a ratio less than 2 to 1 as compared to the weight percent of contaminant metals on a portion of said downstream portion of said catalyst bed equivalent to said upstream portion of said catalyst bed.

2. The process defined in claim 1 wherein said contaminant metals are selected from the group consisting of vanadium, nickel, iron, sodium, zinc, titanium and copper.

3. The process defined in claim 1 wherein said hydrometallization catalyst comprises a Group VIB metal component and a Group VIII metal component on a porous refractory oxide and said hydrodemetallizing conditions include a temperature from about 600° F. to about 850° F., a hydrogen pressure from about 1000 p.s.i.g. to about 2500 p.s.i.g. and an overall space velocity from about 0.1 to about 1.5 LHSV.

4. The process defined in claim 1 wherein said hydrocarbon oil contains at least about 10 ppmw of nickel and vanadium contaminant metals, calculated as V plus Ni.

5. The process defined in claim 1 wherein said hydrocarbon oil is selected from the group consisting of whole crude oils, atmospheric gas oils, atmospheric residua, vacuum gas oils and vacuum residua.

6. The process defined in claim 1 wherein after at least about 120 days of said contacting in step (1) and in step (2) the weight percent of contaminant metals deposited on said particulate catalyst located in the most upstream quarter of said bed, as calculated on a fresh catalyst basis, is in a ratio of less than about 1.5 to 1 as compared to the weight percent of contaminant metals deposited on said particulate catalyst located in the most downstream quarter of said bed.

7. The process defined in claim 1 wherein quench gas contacts said upstream portion of said catalyst bed or heating gas contacts said downstream portion of said catalyst bed to control said average catalyst bed temperature.

8. The process defined in claim 6 wherein said ratio is in the range between about 0.75 to 1 and 1.25 to 1.

9. The process defined in claim 1 further comprising, in step (1), the simultaneous removal of Conradson carbon from said hydrocarbon oil and, in step (2), the simultaneous removal of Conradson carbon from said product hydrocarbon oil obtained in step (1).

10. The process defined in claim 1 further comprising, in step (1), the simultaneous removal of sulfur from said hydrocarbon oil and, in step (2), the simultaneous removal of sulfur from said product hydrocarbon obtained in step (1).

11. The process defined in claim 1 wherein the contaminant metals removed from said product hydrocarbon obtained in step (1) are in the range from about 75 percent to about 125 percent of the contaminant metals removed from said hydrocarbon oil in step (2).

12. The process defined in claim 1 wherein the contaminant metals removed from said product hydrocarbon obtained in step (1) are in the range from about 90 percent to about 110 percent of the contaminant metals removed from said hydrocarbon oil in step (2).

13. A process for removing contaminant metals from a petroleum hydrocarbon oil containing sulfur and contaminant metals, said process comprising successively contacting a first portion of a particulate hydrodemetallization catalyst under hydrodemetallizing conditions with said hydrocarbon oil in a first reaction zone to produce a product hydrocarbon oil containing less contaminant metals than said hydrocarbon oil and, subsequently, contacting a second portion of said particulate hydrodemetallization catalyst with said product hydrocarbon oil obtained from said first reaction zone under hydrodemetallizing conditions in a second reaction zone to produce a second hydrocarbon oil containing less contaminant metals than said product hydrocarbon oil obtained from said first reaction zone, said first reaction zone having a weighted average catalyst bed temperature controlled at least 5° F. lower than the weighted average catalyst bed temperature of said second reaction zone and wherein said weighted average catalyst bed temperatures in said first and said second reaction zones are sufficient to cause deposition of a weight percent of contaminant metals on said catalyst in said first reaction zone, as calculated on a fresh catalyst basis, in a ratio less than 2 to 1 as compared to the weight percent of contaminant metals on a portion of said catalyst in said second reaction zone equivalent to said portion of said catalyst in said first reaction zone.

14. The process defined in claim 13 wherein said contaminant metals are selected from the group consisting of vanadium, nickel, iron, sodium, zinc, titanium and copper.

15. The process defined in claim 13 wherein said weighted average catalyst bed temperature in said first reaction zone is about 10° F. to about 50° F. lower than the weighted average catalyst bed temperature of said second reaction zone.

16. The process defined in claim 13 wherein said hydrodemetallization catalyst comprises a Group VIB metal component and a Group VIII metal component on a porous refractory oxide and said hydrodemetallization conditions include the presence of added hydrogen at a hydrogen pressure from about 1000 p.s.i.g. to about 2500 p.s.i.g. and at a temperature from about 600° F. to about 850° F.

17. The process defined in claim 13 wherein said hydrocarbon oil contains at least 10 ppmw of nickel and vanadium contaminant metals, calculated as V plus Ni.

18. The process defined in claim 16 further comprising contacting a second product hydrocarbon obtained from said second reaction zone with a hydrodesulfurization catalyst in a third reaction zone under hydrodesulfurization conditions to produce a third product hydrocarbon containing less sulfur than said second product hydrocarbon from said second reaction zone.

19. The process defined in claim 13 wherein said particulate catalyst comprises at least one catalytically active metal on a porous support material and after at least about 120 days of said contacting of said first and said second portions of said particulate catalyst the weight percent of contaminant metals deposited on said particulate catalyst in said first zone, as calculated on a fresh catalyst basis, is in a ratio less than about 1.5 to 1 as compared to the weight percent of contaminant metals deposited on said particulate catalyst in said second reaction zone.

20. The process defined in claim 13 wherein the weighted average catalyst bed temperatures in said first and second reaction zones are controlled so that about 0.75 to about 1.25 times the amount of said contaminant metals deposited on said particulate catalyst in said second reaction zone is deposited on said particulate catalyst in said first reaction zone.

21. The process defined in claim 13 wherein said hydrocarbon oil is selected from the group consisting of whole crude oils, atmospheric gas oils, atmospheric residua, vacuum gas oils and vacuum residua.

22. The process defined in claim 18 wherein both said particulate catalyst and said hydrodesulfurization catalyst comprise at least one hydrogenation metal on a porous refractory oxide support, said particulate catalyst having an average pore diameter greater than the average pore diameter of said hydrodesulfurization catalyst.

23. The process defined in claim 16 wherein no substantial loss in hydrogen partial pressure occurs between said first reaction zone and said second reaction zone and said demetallizing conditions include an overall space velocity from about 0.1 to about 1.5 LHSV.

24. The process defined in claim 13 wherein after about 175 days of said contacting of said first and said second portions of said particulate catalyst the weight percent of said contaminant metals deposited on said particulate catalyst in said first reaction zone, as calculated on a fresh catalyst basis, is in a ratio less than 1.5 to 1 as compared to the weight percent of said contaminant metals deposited on said particulate catalyst in said second reaction zone.

25. The process defined in claim 13 further comprising, in said first reaction zone, the simultaneous removal of Conradson carbon from said hydrocarbon oil and, in said second reaction zone, the simultaneous removal of Conradson carbon from said product hydrocarbon obtained from said first reaction zone.

26. The process defined in claim 13 further comprising, in said first reaction zone, the simultaneous removal of sulfur from said hydrocarbon oil and, in said second reaction zone, the simultaneous removal of sulfur from said product hydrocarbon obtained from said first reaction zone.

27. The process defined in claim 13 wherein said hydrocarbon oil further contains nitrogen and asphaltenes.

28. A multi-reaction zone process for hydrodemetallizing and hydrodesulfurizing a petroleum hydrocarbon oil containing sulfur and contaminant metals, said process comprising the following steps:

(1) contacting a first portion of a hydrodemetallization catalyst under hydrodemetallization conditions with said hydrocarbon oil in a first reaction zone to produce a product hydrocarbon oil containing less contaminant metals than said hydrocarbon oil, said hydrodemetallization catalyst comprising at least one Group VIB metal hydrogenation component and at least one Group VIII metal hydrogenation component on a porous refractory oxide support containing alumina;

(2) contacting a second portion of said hydrodemetallization catalyst in a second reaction zone with the product hydrocarbon obtained from step (1) under said hydrodemetallization conditions of step (1) except at a weighted average catalyst bed temperature controlled at least 5° F. higher than the weighted average catalyst bed temperature in said first reaction zone to produce a second product hydrocarbon oil containing less contaminant metals than said product hydrocarbon oil obtained in step (1) and wherein said weighted average catalyst bed temperatures in said first and said second reaction zones are sufficient to cause deposition of a weight percent of contaminant metals on said catalyst in said first reaction zone, as calculated on a fresh catalyst basis, in a ratio less than 2 to 1 as compared to the weight percent of contaminant metals on a portion of said catalyst in said second reaction zone equivalent to said portion of said demetallization catalyst in said first reaction zone; and (3) contacting a hydrodesulfurization catalyst under hydrodesulfurization conditions with the product hydrocarbon obtained from step (2) in a third reaction zone, said hydrodesulfurization catalyst comprising at least one Group VIB metal hydrogenation component and at least one Group VIII metal hydrogenation component on a porous refractory oxide support containing alumina, said hydrodesulfurization catalyst having an average pore diameter of at least 30 angstroms less than the average pore diameter of said hydrodemetallization catalyst.

29. The process defined in claim 28 wherein said hydrocarbon oil is selected from the group consisting of atmospheric residua, atmospheric gas oils, vacuum residua and vacuum gas oils.

30. The process defined in claim 28 wherein said hydrodemetallization catalyst has an average pore diameter from about 120 angstroms to about 220 angstroms and said hydrodesulfurization catalyst has an average pore diameter from about 40 to about 110 angstroms.

31. The process defined in claim 28 wherein said hydrocarbon oil contains at least about 50 ppmw of nickel and vanadium contaminant metal, calculated as V plus Ni.

32. The process defined in claim 28 wherein said weighted average catalyst bed temperature in said second reaction zone is about 5° F. to about 50° F. higher than said weighted average catalyst bed temperature in said first reaction zone.

33. The process defined in claim 28 wherein no substantial losses in hydrogen partial pressure occur between said first reaction zone and said second reaction zone and said third reaction zone and said hydrodemetallizing conditions include a temperature from about 600° F. to about 850° F., a hydrogen pressure from about 1000 p.s.i.g. to about 2500 p.s.i.g. and an overall space velocity from about 0.1 to about 1.5 LHSV.

34. The process defined in claim 28 wherein after about at least 175 days of said contacting in said step (1) and in said step (2), the weight percent of said contaminant metals deposited on said hydrodemetallization catalyst in said first reaction zone, as calculated on a fresh catalyst basis, is in a ratio less than 1.5 to 1 as compared to the weight percent of contaminant metals deposited on said hydrodemetallization catalyst in said second reaction zone.

35. The process defined in claim 28 wherein said contaminant metals are selected from the group consisting of vanadium, nickel, iron, sodium, zinc, titanium and copper.

36. The process defined in claim 28 wherein said hydrodesulfurization conditions comprise a weighted average catalyst bed temperature in said third reaction zone that is lower than said weighted average catalyst bed temperature in said second reaction zone.

37. The process defined in claim 34 wherein said ratio is in the range between about 0.75 to 1 and about 1.25 to 1.

38. A catalytic process for removing contaminant metals from a petroleum hydrocarbon oil containing contaminant metals, Conradson carbon and sulfur, said catalytic process comprising the following steps:

(1) contacting a particulate hydrodemetallization catalyst under hydrodemetallization conditions with said hydrocarbon oil in a first reaction zone to produce a product hydrocarbon containing less contaminant metals than said hydrocarbon oil, and (2) subsequently contacting a second portion of said particulate hydrodemetallization catalyst under hydrodemetallization conditions with a product hydrocarbon oil obtained from step (1) in a second reaction zone to produce a second product hydrocarbon containing substantially less contaminant metals, sulfur and Conradson carbon than said hydrocarbon oil, said first reaction zone having a weighted average catalyst bed temperature controlled at least 5° F. lower than the weighted average catalyst bed temperature of said second reaction zone and wherein said weighted average catalyst bed temperatures in said first and said second reaction zones are sufficient to cause deposition of a weight percent of contaminant metals on said catalyst in said first reaction zone, as calculated on a fresh catalyst basis, in a ratio less than 2 to 1 as compared to the weight percent of contaminant metals on a portion of said catalyst in said second reaction zone equivalent to said portion of said catalyst in said first reaction zone.

39. The process defined in claim 38 wherein said contaminant metals are selected from the group consisting of vanadium, nickel, iron, sodium, zinc, titanium and copper.

40. The process defined in claim 38 wherein quench gas contacts said particulate hydrodemetallization catalyst in said first reaction zone or heating gas contacts said particulate hyrodemetallization catalyst in said second reaction zone to control said average catalyst bed temperature, said particulate hydrodemetallization catalyst comprises a Group VIB metal component and a Group VIII metal component on a porous refractory oxide and said hydrodemetallization conditions include the presence of added hydrogen, a temperature from about 600° F. to about 850° F., a hydrogen pressure from about 1000 p.s.i.g. to about 2500 p.s.i.g. and an overall space velocity from about 0.1 to about 1.5 LHSV.

41. The process defined in claim 38 wherein said hydrocarbon oil comprises asphaltenes.

42. The process defined in claim 38 wherein said hydrocarbon oil comprises nitrogen.

43. The process defined in claim 38 wherein said hydrocarbon comprises vacuum tower bottom fractions or atmospheric tower bottom fractions.

* * * * *